United States Patent [19]

Anderson

[11] Patent Number: 4,480,624

[45] Date of Patent: Nov. 6, 1984

[54] CAPACITOR DISCHARGE IGNITION SYSTEM FOR INTERNAL COMBUSTION ENGINE

[75] Inventor: Philip A. Anderson, Waukegan, Ill.

[73] Assignee: Outboard Marine Corporation, Waukegan, Ill.

[21] Appl. No.: 523,614

[22] Filed: Aug. 17, 1983

[51] Int. Cl.[3] ..... F02P 1/00

[52] U.S. Cl. ..... 123/602; 123/605; 123/418

[58] Field of Search ..... 123/602, 605, 418, 653, 123/650

[56] References Cited

U.S. PATENT DOCUMENTS 4,377,997 3/1983 Staerti ..... 123/602

4,391,236 7/1983 Anderson ..... 123/605

4,413,608 11/1983 Beeghly ..... 123/602

*Primary Examiner*—Ronald B. Cox

*Attorney, Agent, or Firm*—Michael, Best & Friedrich

[57] ABSTRACT

The capacitor discharge ignition system for an internal combustion engine includes an ignition capacitor charged by a power supply and discharged through the primary of an ignition coil when a silicon controlled rectifier (SCR) becomes conductive in response to a trigger voltage is applied to the gate of the SCR. A resistor-capacitor delay circuit on the output of the SCR delays rapid discharge of the capacitor to thereby delay the spark at the spark plug in the secondary of the coil. A second SCR is connected to shunt the RC time delay to effectively advance the spark timing in response to predetermined engine speed.

4 Claims, 1 Drawing Figure

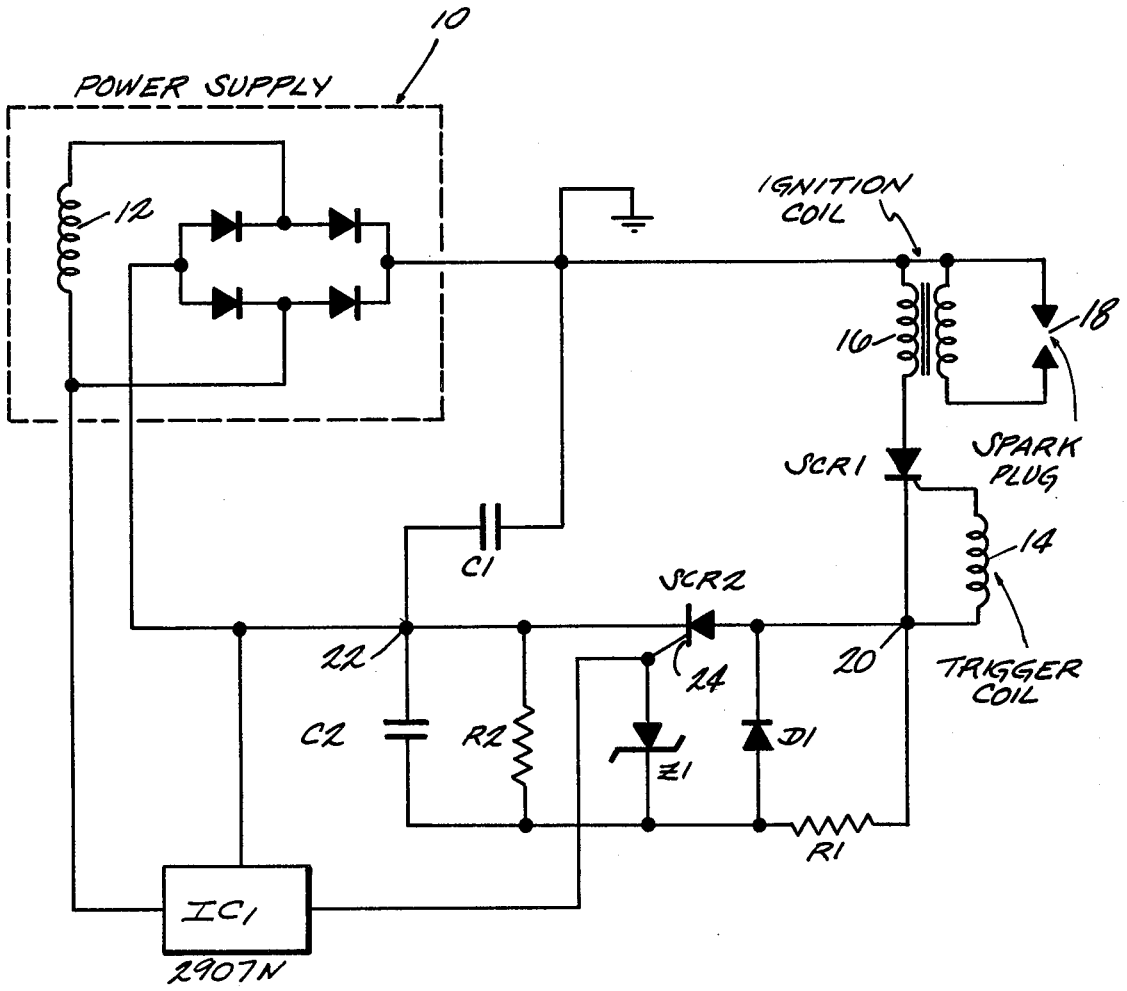
10
POWER SUPPLY
12
IGNITION COIL
16
18
SPARK PLUG
SCR1
14
TRIGGER COIL
C1
SCR2
22
24
20
C2
R2
Z1
D1
R1
IC1
2907N

CAPACITOR DISCHARGE IGNITION SYSTEM FOR INTERNAL COMBUSTION ENGINE

FIELD OF THE INVENTION

This invention relates to capacitor discharge (CD) ignition systems for internal combustion engines.

BACKGROUND OF THE INVENTION

CD ignition systems are widely used for internal combustion engines. Control of the spark timing has generally relied on mechanical arrangements which do not provide the full range of advance/retard which can be visualized. For example, it is desirable to advance the spark of an outboard motor in the mid-range of speed well past the maximum advance which is acceptable at full speed. Conventional engine controls don't provide for such mid-range advance and the potential improved performance and economy are not attained. It is desirable to provide more elaborate and complete control of the timing.

SUMMARY OF THE INVENTION

The invention provides a capacitor discharge ignition system for an internal combustion engine, which system comprises an ignition circuit path including, in series, a charge capacitor, a primary ignition coil, a first semi-conductor switch having a first control element, and a second semi-conductor switch having a second control element, means including a trigger coil connected to the first control element and a magnet rotatable relative to the trigger coil for applying a trigger voltage to the first control element to render conductive the first semi-conductor switch, a resistor-capacitor time-delay circuit connected to the circuit path between the first and second semi-conductor switches, a zener diode having a cathode connected to the resistor-capacitor time-delay circuit, and an anode connected to the second control element for applying a trigger voltage to the second control element to render conductive the second semi-conductor switch after a predetermined time-delay, and means connected to the second control element in parallel with the connection of the anode of the zener diode and responsive to engine speed for applying a trigger voltage to the second control element to render conductive the second semi-conductor switch so as to advance the spark timing at a predetermined speed.

The invention also provides a capacitor discharge ignition system for an internal combustion engine, which system comprises an ignition circuit path including, in series, a charge capacitor, a primary ignition coil, a first semi-conductor switch having a first control element, and a second semi-conductor switch having a second control element, means connected to the charge capacitor for charging thereof, means including a trigger coil connected to the first control element and a magnet rotatable relative to the trigger coil for applying a trigger voltage to the first control element to render conductive the first semi-conductor switch, a resistor-capacitor time-delay circuit connected to the circuit path between the first and second semi-conductor switches, a zener diode having a cathode connected to the resistor-capacitor time-delay circuit, and an anode connected to the second control element for applying a trigger voltage to the second control element to render conductive the second semi-conductor switch after a predetermined time-delay, a frequency-to-voltage convertor connected to the second control element in parallel with the connection of the anode of the zener diode, connected to the means for charging the charge capacitor, and responsive to pulses representative of engine speed for applying a trigger voltage to the second control element to render conductive the second semi-conductor switch at a preselected engine speed, thereby bypassing the time-delay circuit so as to advance the timing.

The invention also provides an internal combustion engine including a capacitor discharge ignition system as set forth in each of the two preceding paragraphs.

This invention is not limited to the details of construction and the arrangement of components set forth in the following description or illustrated in the drawings. The invention is capable of other embodiments and of being practiced and carried out in various ways. The phraseology and terminology employed herein is for the purpose of description and should not be regarded as limiting.

BRIEF DESCRIPTION OF THE DRAWINGS

The single FIGURE is a schematic diagram which does not include the rotating magnets which induce voltage in the power supply coil and the trigger coil. Such structure is notoriously old and well known. Only the integrated circuit chip is specifically identified and it will be apparent other chips and processers could be used.

DETAILED DESCRIPTION OF THE DRAWINGS

The power supply 10 is a conventional alternator in which voltage pulses are induced in coil 12 as a rotating permanent magnet passes close to the coil. The pulses are used as a measure of speed and are supplied to the 2907N integrated circuit IC for purposes which will appear hereafter. The power supply charges capacitor $C_1$. The engine is provided with a trigger coil 14 and, a rotating magnet (not shown) induces a trigger voltage in the coil. The trigger voltage is applied to the gate of $SCR_1$ to cause the SCR to conduct. In the usual CD ignition system conduction of $SCR_1$ would apply full capacitor voltage to the primary of the ignition coil 16 to induce a high voltage in the secondary and cause a spark at the spark plug 18.

In the present invention, however, the output of $SCR_1$ is connected to the other side of the power supply through resistance $R_1$ and capacitor $C_2$ which constitute an RC time delay circuit preventing rapid discharge of capacitor $C_1$ and therefore preventing (or delaying) a spark at plug 18.

A second silicon controlled rectifier $SCR_2$ *is connected between junctions 20, 22 to bypass the R-C time delay when* $SCR_2$ conducts. Conduction of $SCR_2$ is controlled by gate 24 which can be triggered by either of two ways. In normal operation without automatic spark advance the gate is triggered when the charge on capacitor $C_2$ reaches the breakdown voltage of the Zener diode and the diode conducts and triggers $SCR_2$. This now bypasses the time delay and the full voltage on the ignition capacitor $C_1$ is rapidly discharged through the primary of the ignition coil to cause a spark.

As noted above, the pulses in the power supply are applied to the 2907N integrated circuit which is a frequency to voltage converter. The converter senses preselected speeds to supply a trigger voltage to gate 24 to fire $SCR_2$ and bypass the time delay which means there will be no delay when $SCR_1$ fires. By selection of $R_1C_2$ the timing delay can be say 6° which means elimination of the delay causes an automatic advance of 6°. This means the delayed or normal timing can be 28° BTDC, for example, and the advanced timing can be 34° BTDC which gives superior performance and economy in the mid-range. At maximum speed, however, 34° advance will cause detonation. Therefore, the automatic advance of 6° from 28° BTDC should be cut out before maximum speed. The IC can be set to do that at high speed and can also retard the spark to 28° BTDC at a lower speed. The automatic advance can come in at idle speed to make the engine run smoother. If the speed drops after the automatic advance operates the integrated circuit IC can sense the change in operation (usually caused by load) and retard in spark to avoid detonation.

I claim:

1. A capacitor discharge ignition system for an internal combustion engine, said system comprising an ignition circuit path including, in series, a charge capacitor, a primary ignition coil, a first semi-conductor switch having a first control element, and a second semi-conductor switch having a second control element, means including a trigger coil connected to said first control element and a magnet rotatable relative to said trigger coil for applying a trigger voltage to said first control element to render conductive said first semi-conductor switch, a resistor-capacitor time-delay circuit connected to said circuit path between said first and second semi-conductor switches, a zener diode having a cathode connected to said resistor-capacitor time-delay circuit, and an anode connected to said second control element for applying a trigger voltage to said second control element to render conductive said second semi-conductor switch after a predetermined time-delay, and means connected to said second control element in parallel with the connection of said anode of said zener diode and responsive to engine speed for applying a trigger voltage to said second element to render conductive said second semi-conductor switch so as to advance the spark timing at a predetermined speed.

2. A capacitor discharge ignition system for an internal combustion engine, said system comprising an ignition circuit path including, in series, a charge capacitor, a primary ignition coil, a first semi-conductor switch having a first control element, and a second semi-conductor switch having a second control element, means connected to said charge capacitor for charging thereof, means including a trigger coil connected to said first control element and a magnet rotatable relative to said trigger coil for applying a trigger voltage to said first control element to render conductive said first semi-conductor switch, a resistor-capacitor time-delay circuit connected to said circuit path between said first and second semi-conductor switches, a zener diode having a cathode connected to said resistor-capacitor time-delay circuit, and an anode connected to said second control element for applying a trigger voltage to said second control element to render conductive said second semi-conductor switch after a predetermined time-delay, and a frequency-to-voltage convertor connected to said second control element in parallel with the connection of said anode of said zener diode, connected to said means for charging said charge capacitor, and responsive to pulses representative of engine speed for applying a trigger voltage to said second control element to render conductive said second semi-conductor switch at a preselected engine speed, thereby bypassing said time-delay circuit so as to advance the timing.

3. An internal combustion engine including a capacitor discharge ignition system comprising an ignition circuit path including, in series, a charge capacitor, a primary ignition coil, a first semi-conductor switch having a first control element, and a second semi-conductor switch having a second control element, means including a trigger coil connected to said first control element and a magnet rotatable relative to said trigger coil for applying a trigger voltage to said first control element to render conductive said first semi-conductor switch, a resistor-capacitor time-delay circuit connected to said circuit path between said first and second semi-conductor switches, a zener diode having a cathode connected to said resistor-capacitor time-delay circuit, and an anode connected to said second control element for applying a trigger voltage to said second control element to render conductive said second semi-conductor switch after a predetermined time-delay, and means connected to said second control element in parallel with the connection of said anode of said zener diode and responsive to engine speed for applying a trigger voltage to said second control element to render conductive said second semi-conductor switch so as to advance the spark timing at a predetermined speed.

4. An internal combustion engine including a capacitor discharge ignition system comprising an ignition circuit path including, in series, a charge capacitor, a primary ignition coil, a first semi-conductor switch having a first control element, and a second semi-conductor switch having a second control element, means connected to said charge capacitor for charging thereof, means including a trigger coil connected to said first control element and a magnet rotatable relative to said trigger coil for applying a trigger voltage to said first control element to render conductive said first semi-conductor switch, a resistor-capacitor time-delay circuit connected to said circuit path between said first and second semi-conductor switches, a zener diode having a cathode connected to said resistor-capacitor time-delay circuit, and an anode connected to said second control element for applying a trigger voltage to said second control element to render conductive said semi-conductor switch after a predetermined time-delay, and a frequency-to-voltage covertor connected to said second control element in parallel with the connection of said anode of said zener diode, connected to said means for charging said charge capacitor, and responsive to pulses representative of engine speed for applying a trigger voltage to said second control element to render conductive said second semi-conductor switch at a preselected engine speed thereby bypassing said time-delay circuit so as to advance the timing.

* * * * *